United States Patent [19]

Jimae

[11] 4,377,239

[45] Mar. 22, 1983

[54] BRUSH RACK

[76] Inventor: James Jimae, 19 Harold St., Matraville, Sydney N.S.W., Australia

[21] Appl. No.: 7,360

[22] Filed: Jan. 29, 1979

[51] Int. Cl.[3] ..... A47F 7/00

[52] U.S. Cl. ..... 211/65; 211/94; 211/60 T; 248/110

[58] Field of Search ..... 211/65, 607, 94, 89, 211/60 R; 248/110, 111, 112, 113; 24/85 B, 84 B

[56] References Cited

U.S. PATENT DOCUMENTS

| | | | |
|---|---|---|---|
| 1,764,763 | 6/1930 | Stang | 248/110 |
| 1,892,500 | 12/1932 | Bleckley | 211/65 X |
| 2,469,864 | 5/1949 | Craft et al. | 248/110 |
| 2,487,516 | 11/1949 | Braswell | 248/110 |
| 2,605,624 | 8/1952 | Halladay | 24/84 B X |
| 2,625,299 | 1/1953 | Uhlig | 211/65 X |
| 2,703,652 | 3/1955 | Dominik | 211/65 |
| 2,788,153 | 4/1957 | Broadbelt | 248/110 X |
| 3,515,284 | 6/1970 | Taylor | 211/94 X |

FOREIGN PATENT DOCUMENTS

| | | | |
|---|---|---|---|
| 1084718 | 7/1954 | France | 248/113 |

OTHER PUBLICATIONS

Popular Mechanics, Mar. 1948, p. 120, "Wire Clip Snap on Rim of Can to Hold Paintbrushes off Bottom".

*Primary Examiner*—Francis K. Zugel
*Assistant Examiner*—Robert W. Gibson, Jr.
*Attorney, Agent, or Firm*—Robert J. Van Der Wall

[57] ABSTRACT

A brush rack having a lower surface or land for supporting a brush, the land having at one end a saddle formed from the land and two upwardly depending ears adjacent thereto. At the other end of the land is a flared sill capable of providing support for the full width of a brush. The brush rack is equipped with at least one downwardly depending angled tongue for engagement with the circular groove of a paint can, or with a corresponding slanted channel in a support means.

3 Claims, 6 Drawing Figures

BRUSH RACK

Field of the Invention

This invention relates to the field of devices for supporting and retaining brushes, and, in particular, to racks for supporting and retaining paint brushes whether on a paint can, work bench, or tool storage area.

Background of the Invention

Although much of present day painting is achieved using a variety of spreading methods including spray, rollers, and the like, it remains necessary in painting that certain types of work be done with a hand held brush. One of the persistent problems with paint brushes in use is where to place them when painting is temporarily interrupted, or when different brushes must be used. Frequently, a paint brush is used in connection with a conventional one gallon can of paint having therein a slightly resilient circular groove intended to accept a corresponding circular tongue on the lid. The tongue of the lid and groove of the can, of course, are used to seal the lid on the can. However, the groove on the can readily catches paint when the can is used with a brush, and lying a brush down on the can almost invariably gets paint on the handle of the brush which, in turn, must either be wiped off or gets all over the hand of the painter. In short, using a paint can and brush together has usually been messy.

The alternative, of course, is to lay the brush on some other surface, but then the bristles of the paint brush come in contact with whatever surface the brush is laid upon, and since the bristles are generally coated with paint, this procedure is also messy.

Various inventive activity has been directed to the difficulties of using a paint brush with a paint can. Oft time this activity has been combined with wall bracket type brushholders, as in the present invention.

As example of this art is Vetterli, et al., U.S. Pat. No. 2,675,979. Unfortunately, Vetterli suspends the paint brush well down into the can in a manner most inappropriate when the can is full. In fact, the bracket for supporting the brush itself has a member called a resilient tongue 13 depending therefrom which extends well down into the can, which would also be submerged beneath the paint when the can is full. The invention of Davis, U.S. Pat. No. 2,674,391 is an improvement thereover, takes advantage of the circular groove in the top of the can for attachment and support of the invention, but is limited to a single sized paint can, is itself quite subject to becoming covered with paint in a manner detrimental to its use and operation, and is cumbersome to use.

Hansen, U.S. Pat. No. 2,340,660 suffers from the same disadvantage of holding the brush down within the can as Vetterli, et al. Currently, Pierce, U.S. Pat. No. 2,450,736 suffers the same defect, or, in the alternative, if used on the outside of the can, it would not limit drippings of the brush to within the can.

There is a demonstrated need for a device which would attach to any size paint can, would suspend the brush over the can without the brush projecting extensively into the can, which would permit drippings from the brush to return to the supply of paint within the can, and, preferably, a device which could be used in combination with support brackets for use on level surfaces or mounting on wall brackets for storage of the brush when not in use as a tool.

SUMMARY OF THE INVENTION

With the foregoing in mind, it is a principle object of the invention to provide a brush rack which can be utilized with any size paint can for supporting a paint brush above a can of paint without regard to how full the can of paint is.

Another object of the invention is to provide a brush rack which will support the brush in the manner so that drippings will return to the supply of paint in the can without contact with the rack or handle of the brush.

A further object of the invention is to provide a brush rack, suitable for use on any size paint can, which may also be utilized in combination with support brackets for use on level surfaces.

A similar object of the invention is to provide a brush rack suitable for use with any size paint can which may also be combined with support means utilized as a wall bracket for storage of the brush as a tool when not in use.

A further object of the invention is to provide a brush rack which, when used with a paint can, receives its support therefrom to simplify and render economical to manufacture said rack.

Another object of the invention is to provide a brush rack which may be used interchangeably with a great range of different brush sizes without modification.

One more object of the invention is to provide a brush rack having optional support means which will accept as many of the racks as desired, the length of said support means being variable in length.

An additional object of the invention is to provide a brush rack which is reversible.

One more object of the invention is to provide a brush rack which is economical to manufacture, corrosion resistent and which is simple, clean and easy to use.

Other objects and advantages of the invention will become apparent to those skilled in the art upon reading the following descriptions of the invention and upon reference to the appended drawings.

In accordance with the invention there is provided a brush rack having a lower surface or land for supporting the brush, said land having at one end a saddle formed from the land and two upwardly depending ears adjacent thereto. At the other end of the land is a flared sill capable of providing support for the full width of a brush. The brush rack is equipped with at least one downwardly depending angled tongue for engagement either with the circular groove of a paint can, or with a corresponding slanted channel in a support means.

Of course, a plurality of brush racks may be located in the circular groove of a given paint can if more than one brush is to be utilized, and a plurality of brush racks may also be engaged with the support means at any point along the length of the slanted channel. The support means may be used either on horizontal or vertical surfaces and contains perforations so that it may be attached to vertical surfaces of the like.

The brush rack is designed with the tongue having an angle from the rack so that the rack will be tilted with respect to a paint can, usually downward. This results in excess paint running off the end of the bristles, dropping back to the supply of paint within the can, but not resulting in such a loss of paint within the bristles that the brush must necessarily be redipped in the paint before it is again used. On the other hand, the brush rack is intended to be reversible to that the rack may be mounted in an ascending posture, if desired, thus raising the brush higher above the top of the can. The upwardly depending ears which form a saddle at one end of the rack provide means preventing the brush from slipping off the rack and may also serve to hold the neck of the brush handle if the brush is of an appropriate size. Naturally various size brush racks with corresponding sized saddles would be provided for a variety of brush sizes, but all with be provided with the downwardly depending angled tongue such that a variety of different brush racks may be used with a single support means.

The invention will be better understood after reading the following detailed description of the embodiments thereof with reference to the appended drawings, in which:

DETAILED DESCRIPTION

Figure 1:
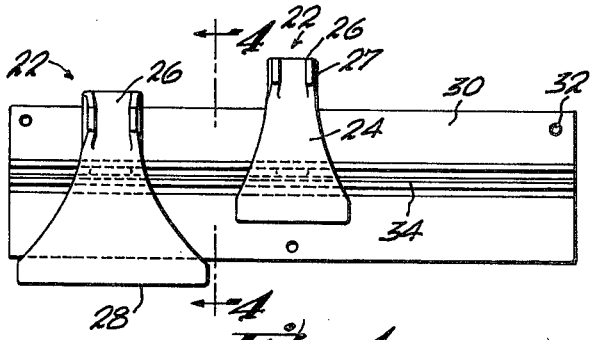
FIG. 1 is a plan view of the invention showing two brush racks on a support means.

Referring now to FIG. 1, brush racks 22 are shown. Each has a land 24 terminating at one end with a saddle 26 comprised of upwardly depending ears 27. On the opposite end of the land 24 is a flared sill 28 for full width support of a brush.

The brush racks 22 are shown in cooperation with support means 30 having perforations 32 for mounting and containing therein a slanted channel 34.

Figure 2:
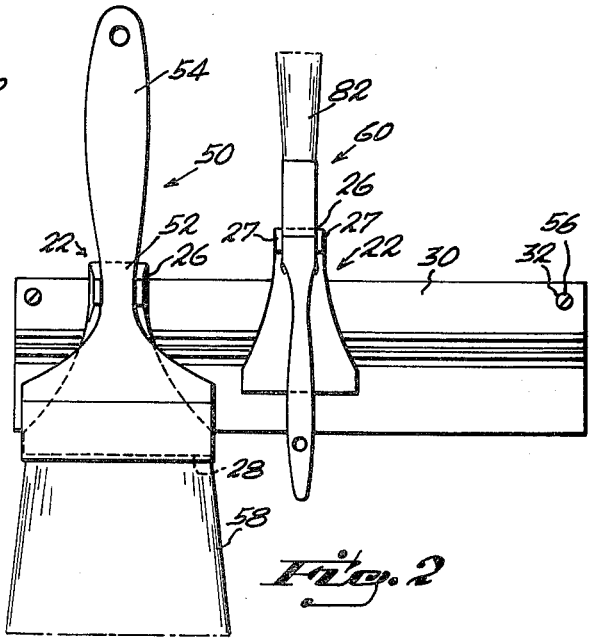
FIG. 2 is another plan view of the invention showing brush racks of two different sizes supporting two different brushes, and illustrating that the racks are reversible with regard to brush orientation.

Turning now to FIG. 2, a large brush 50 is shown with the neck 52 of the handle 54 positioned in close fitting relationship in saddle 26 the brush racks 22 are again shown in cooperation with support meand 30 in which perforations 32 are equipped with fasteners 56 it will be seen also that the bristles 58 of brush 50 are supported outward of the flared sill 28 a smaller brush 60 is shown in the reverse configuration and with the full brush width sandwiched between ears 27 of the saddle 26 this latter mode illustrates the reversibility of the brush rack.

Figure 3:
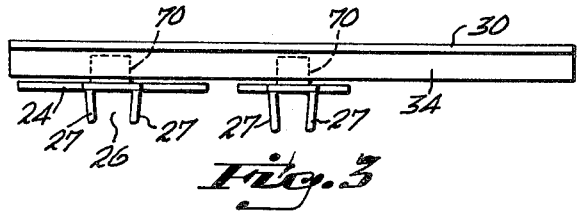
FIG. 3 is an end view of FIG. 1, principally illustrating the downwardly depending angled tongues of the racks captures within the slanted channel of the support means.

In FIG. 3, support means 30 is shown contiguous with slanted channel 34 in which is inserted downwardly depending angled tongue 70. Also shown are upwardly depending ears 27 forming the saddle 26 and land 24.

Figure 4:
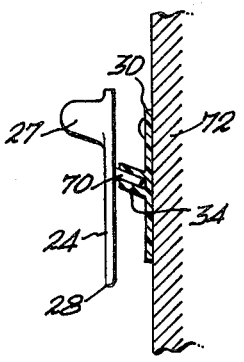
FIG. 4 is a cross-section view taken along the line 4—4 of FIG. 1 and showing how the compensating angle of the tongue and slant of the channel result in the brush rack being substantially parallel to the support means.

In FIG. 4, support means 30 is shown attached to surface 72. Angled tongue 70 is shown captures by slanted channel 34 with compensating angularity there between resulting in substantial parallelism between surface 72 and brush rack land 24. Upwardly depending ears 27 and flared sill 28 are also shown.

Figure 5:
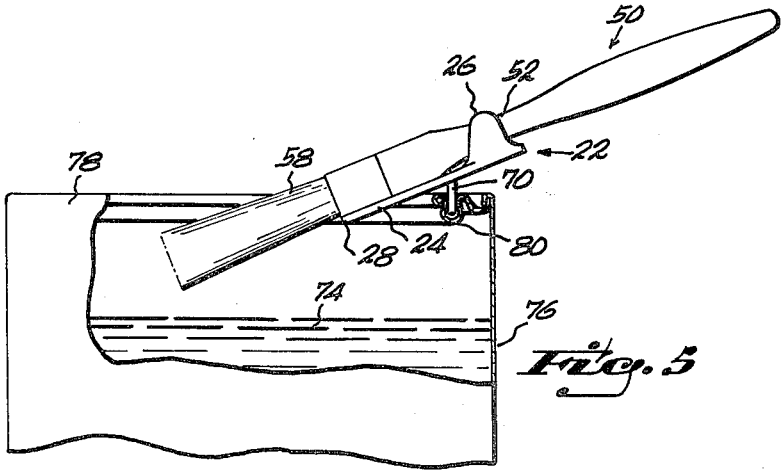
FIG. 5 shows in partially broken view the preferred embodiment of the brush rack when in use with a paint can, and primarily illustrating the insertion of the downwardly depending angled tongue inserted into the circular groove of the paint can.

In FIG. 5, a large brush 50 is shown cradled on brush rack 22, held in place by saddle 26, supported by land 24 to allow the bristles 58 to hang beyond flared sill 28 at a convenient angle above the surface 74 of paint 76 within paint can 78. Downwardly depending tongue 70 is shown captured within circular groove 80 which is conventionally a portion of paint can 78. The neck 52 of paint brush 50 is held and restrained within saddle 26, thereby preventing the brush from sliding downward across brush rack 22 toward the paint surface 74.

Figure 6:
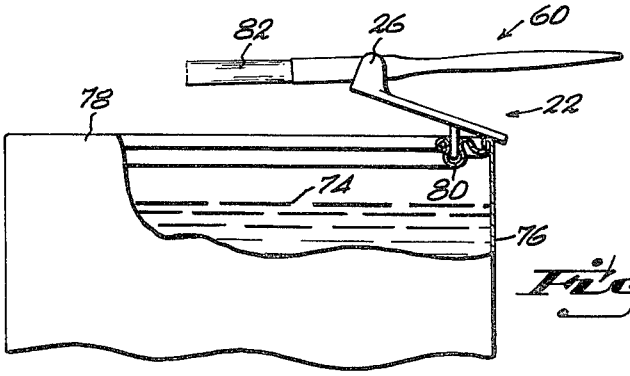
FIG. 6, also in partially broken view, shows the reversibility of the brush rack and illustrates the same in an ascending posture.

Turning finally to FIG. 6 brush rack 22 is used in its reversible mode with saddle 26 shown inside paint can groove 80 in ascending posture with saddle 26 containing the full width of small brush 60, still supporting the bristles 82 over the surface 74 of paint 76 in paint can 78.

Having described the presently preferred embodiments of the invention, it should be understood that various changes in construction and arrangement will be apparent to those skilled in the art and are fully contemplated here with departing from the true spirit of the invention. Accordingly, there are covered all alternatives, modifications, and equivalents as may be included within the spirit and scope of the invention as defined herein solely by the appended claims.

What is claimed is:

1. A one piece unitarily formed brush rack and removable support comprising:

a brush supporting land;

a saddle in the land, said saddle formed from the land and upwardly depending ears thereto;

a flared sill in the land opposite the saddle;

a tongue downwardly depending from the land;

support means; and at least one U-shaped parallel sided planar channel in the support means for removable engagement with the tongue.

2. The brush rack of claim 1 wherein the support means is provided with perforation for attachment to work or storage surfaces.

3. The brush rack of claim 2 wherein the tongue depends downwardly at other than a right angle from a plane of the land and the channel of the support means possesses substantially compensating angularity with a plane of the support means.

* * * * *